US005992185A

United States Patent [19]

Leeke et al.

[11] Patent Number: 5,992,185

[45] Date of Patent: Nov. 30, 1999

[54] UPHOLSTERY FABRIC

[75] Inventors: Gary John Leeke, Sterling Hts; Debra Jean Tiensivu, Clinton Township; Giles Timothy Gregory, Sterling Heights, all of Mich.

[73] Assignee: Lear Corporation, Southfield, Mich.

[21] Appl. No.: 08/968,721

[22] Filed: Nov. 12, 1997

[51] Int. Cl.[6] ..... D04B 1/14

[52] U.S. Cl. ..... 66/170; 66/196; 297/218.1

[58] Field of Search ..... 297/218.5, 218.1, 297/226; 66/172 R, 170, 169 R, 198, 60 R, 173, 174, 171

[56] References Cited

U.S. PATENT DOCUMENTS 5,308,141 5/1994 Robinson et al. ..... 297/218
5,326,150 7/1994 Robinson et al. ..... 297/218
5,428,969 7/1995 Day et al. ..... 66/202
5,720,188 2/1998 Leeke et al. ..... 66/172 R
5,890,381 4/1999 Leeke et al. ..... 66/172 R

*Primary Examiner*—John J. Calvert
*Assistant Examiner*—Larry D. Worrell, Jr.
*Attorney, Agent, or Firm*—Brooks & Kushman PC

[57] ABSTRACT

A three-dimensional continuously knitted fabric cover knitted from yarn in a generally double jersey construction for covering a three-dimensional core, the fabric cover having an exposed front layer with a rear layer adjacent the core having formed integrally therewith a securing means formed as a coursewise extending single jersey tubular portion which is less extensible than the surrounding fabric, with single jersey tie-down loops formed at each end of the tubular portion.

9 Claims, 2 Drawing Sheets

UPHOLSTERY FABRIC

TECHNICAL FIELD

This invention relates to upholstery fabrics intended in use to cover at least part of the surface of a three-dimensional structure and in particular but not exclusively to upholstery for seats, especially vehicle seats.

BACKGROUND OF THE INVENTION

Three-dimensional fabric covers for seats have in the past been produced from woven or knitted fabric which has been cut into shaped panels which are then sewn together.

More recently it has been found possible to continuously knit one-piece piece upholstery fabric, which removes the need for cutting and sewing, and has the desired shape to serve as covers for the back and base cushions of motor vehicle seats; see, for example, U.S. Pat. Nos. 5,308,141 and 5,326,150.

It is necessary to provide anchorage devices at the edges of the covers to enable the covers to be secured to a support and held tautly over their respective cushions. The anchorage devices typically take the form of tubular portions which may be formed by sewing or by integrally knitting said portions. The tubular portions accommodate rods which are recessed into the cushions and secured under the support. If the base and back cushions comprise bolsters, it may also be necessary to provide anchorage devices on the undersurface of the cover in order to conform the cover to the shape of the upper surface of the cushion. The anchorage devices are typically open ended tubular flaps which are formed by sewing or integral knitting as shown in U.S. Pat. No. 5,326,150. It is difficult to hold the central panel of a seat back cover down against the foam cushion. It is not usually possible to utilize metal rods and hog rings in this region. Typically the cover is held in place by adhesives, Velcro™, or more usually by passing elastomeric cord through the flaps and anchoring each end of the tensioned cord to a suitable point on the seat support. These anchorage points have to be hidden from sight.

The elastomeric cord, tubular flap formation, threading of the cord and location of the anchorage means are costly.

SUMMARY OF THE INVENTION

According to the invention, there is provided a fabric cover knitted from yarn in a generally double jersey construction for covering a three-dimensional core, the fabric cover having an exposed front layer with a rear layer adjacent the core, the rear layer of the cover having formed integrally therewith a coursewise extending single jersey tubular portion which is less extensible than the surrounding fabric, with single jersey tie-down loops formed at each end of the tubular portion.

The loops provide anchorage points for pulling the non-extensible coursewise linear area down onto the core and preventing bridging. The formation of the tubular portion and tie-down loops is substantially invisible on the front face.

Preferably, the tubular portion comprises six to 20 courses, and preferably 16 courses of single jersey knitting of a cross float construction, and the tie-down loops comprise 25 to 60 courses of cross float single jersey fabric, and preferably 38 to 40 courses.

Preferably, the single jersey tubular portion and the single jersey tie down loops are knitted in a cross float construction in which in each row of knitting the yarn is knitted for a single loop at intervals which do not exceed four wales, and more preferably every other wale.

The tubular portion and tie down loops may be knitted from a high modulus yarn, such as HYTREL or LYCRA, preferably a 1000 denier monofilament.

Also according to the invention there is provided a method of knitting a fabric cover of a generally double jersey construction on a flat "V" bed knitting machine having a front bed for knitting the front layer of the fabric and a rear bed for knitting the rear layer of the fabric, the method including knitting a double jersey fabric on both needle beds, and at a predetermined course of knitting the front needle bed is held up, and knitting continues on selected needles on the rear needle bed up to a second course. Thereafter, knitting continues on a group of needles at each end of the selected needles up to a third predetermined course, then knitting recommences on all selected needles up to a fourth predetermined course. Thereafter, knitting recommences on all needles on both needle beds to form fabric having on the rear layer a pair of tie-down loops having a single jersey tubular portion extending coursewise therebetween.

Preferably, the fabric is knitted on a machine having seven to 14 needles per inch, and preferably 12 needles per inch. The double jersey fabric is knitted from at least one yarn which is preferably air textured polyester yarn having a decitex in the range of 500–800 decitex, or could be chenille yarn of the type disclosed in U.S. Pat. No. 5,428,969 which has a ground yarn with a count in the range 550–900 decitex and a chenille yarn having a decitex in the range of 1700–5000.

Yet another aspect of the invention provides a method of securing a double jersey knitted fabric cover to a core by integrally knitting a pair of tie-down loops in the rear layer of the fabric, the tie-down loops being spaced apart in a coursewise direction and being interconnected by a coursewise extending tubular portion which is less extensible that the surrounding fabric, and wherein the loops are utilized for putting the cover under tension to pull the cover against a respective core.

The cover is preferably for a motor vehicle seat cushion or back.

BRIEF DESCRIPTION OF THE DRAWINGS

This invention will be described by way of example and with reference to the accompanying drawings in which.

DESCRIPTION OF THE PREFERRED EMBODIMENT

Figure 1:
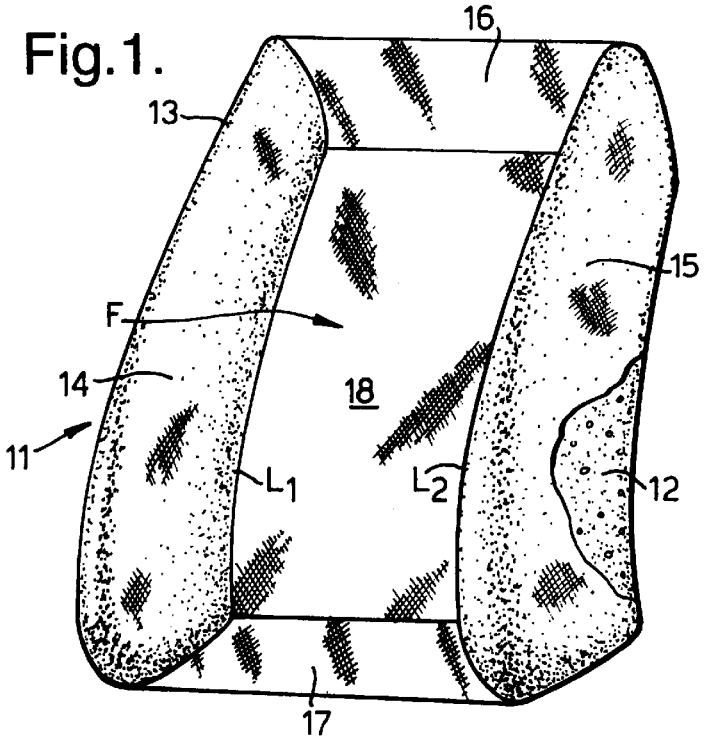
FIG. 1 is a seat back in accordance with the present invention.

Referring to FIG. 1, this shows an isometric view of a seat back 11 having a foam core 12 covered by a double jersey knitted fabric cover 13. The foam core 12 is typically mounted on a metal frame to which the cover 13 is secured to hold the cover tautly against the surface of the core.

The cover 13 is continuously knitted in three dimensions on a flat "V" bed knitting machine having independently operable needle beds. The seat back 11 may comprise a front F having side bolsters 14, 15 and top and bottom bolsters 16, 17. The cover 13 when fitted over the core 12 has a central front panel 18 which, as a consequence of the presence of bolsters 14–17, can bridge the core 12. The cover 13 therefore requires pulling down and holding against the surface of the foam core. This also prevents shuffling of the cover on the core. The cover is held in tension along at least two vertical lines L1 and L2 lying one on each side of the central panel 18. The vertical lines L1 and L2 correspond with the coursewise direction of knitting for the double jersey fabric cover 13.

Figure 3:
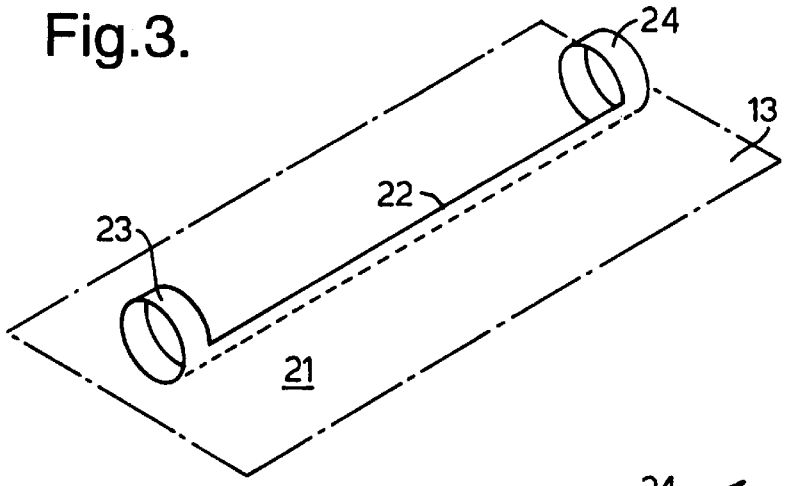
FIG. 3 is an isometric view of the rear face of a fabric piece according to the invention.
Figure 4:
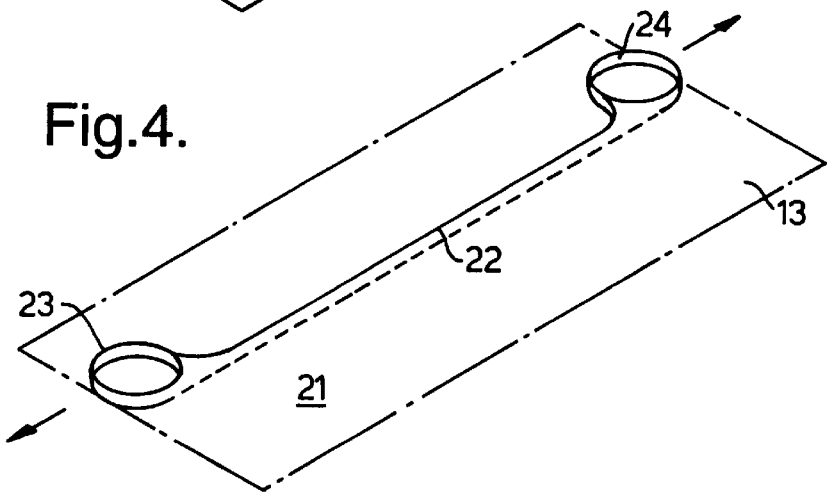
FIG. 4 is a view of the fabric piece of FIG. 3 in tension when in use.

With reference to FIGS. 3 and 4, there is shown in rear view a portion of the cover 13 having on its rear face 21 a coursewise extending tubular portion 22 which is less extensible than the surrounding double jersey fabric. The tubular portion 22 has a larger tie down loop 23, 24 formed at each end thereof. The loops 23, 24 and tubular portion are formed contiguously with each other and may have the same knitted construction. The loops 23, 24 are readily deformable into the condition shown in FIG. 4 to transmit a tension load to the fabric which is less extensible between the loops.

Figure 2:
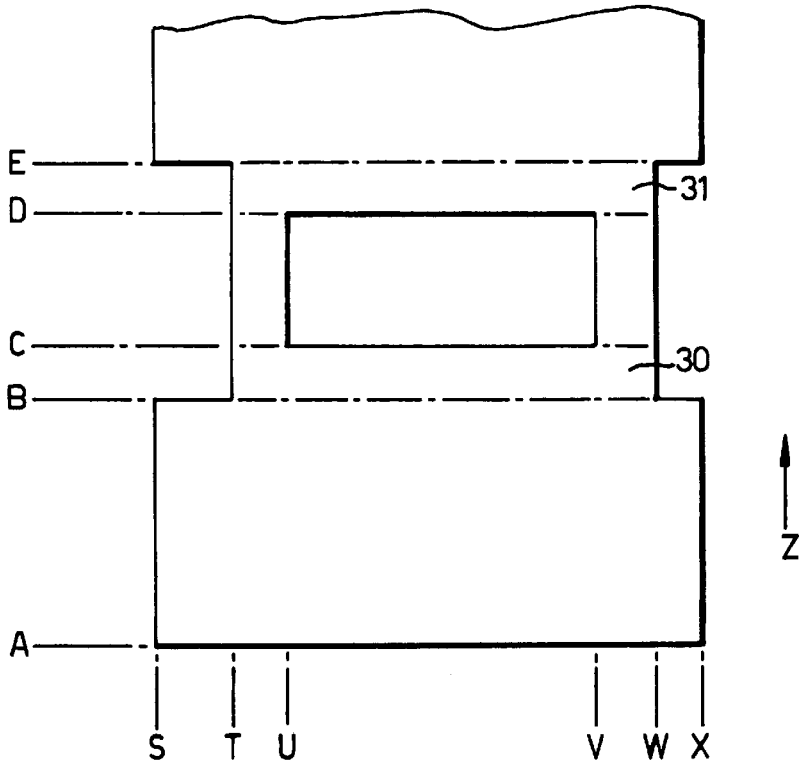
FIG. 2 is a knitting pattern for a fabric piece according to the present invention.

With reference now to FIG. 2, there is shown a knitting pattern 30 for a portion of a cover 13 to illustrate how the less extensible tube 22 and tie-down loops 23, 24 are formed.

Knitting of fabric cover 13 which is of a generally double jersey construction takes place on a flat "V" bed knitting machine having a front bed for knitting the front layer of the fabric and a rear bed for knitting the rear layer of the fabric. The needle beds are shown schematically in FIGS. 5 and 6 in which each dot represents a needle, and the upper row F of dots represents the front needle bed and the lower row R of dots represents the rear needle bed.

Knitting commences at the set up course A in the direction of arrow Z on all needles between the needle lines S and X. A double jersey structure fabric is knitted on both needle beds up to a first predetermined course B. Thereafter, knitting on the front needle bed is held up, and knitting continues for between six to 12 courses, preferably eight courses, on selected needles T-W on the rear needle bed up to a second predetermined course C. The width of the needle bed T-W could be up to 300 needles.

Thereafter knitting continues, for up to between a further 20 to 50 more courses, and preferably 38 courses on two groups of needles T-U and V-W located one group at each end of the selected needles T-W up to a third predetermined course D. The groups of needles T-U and V-W may comprise between six and 25 needles, preferably about 14 needles.

Then knitting recommences on all selected needles T-W for the same number of courses as between courses B and C, up to a fourth predetermined course E. Knitting then recommences on all needles on both needle beds F and R to form the fabric piece.

The tubular portion 22 and loops 23, 24 formed on the rear layer are formed by a single jersey knitting on the needles T-W. The tubular portion 22 is formed by the fabric portions 30 and 31 between the course lines B-C and D-E, respectively, and extends walewise for a total of 16 courses. The tie-down loops 23, 24 preferably extend for a further 38 courses between course lines C-D. Preferably the loops 23, 24 and tubular portion both have the same knit construction.

The preferred construction is to knit the single jersey tubular portion and tie down loops from a cross float type stitch.

Figure 5:
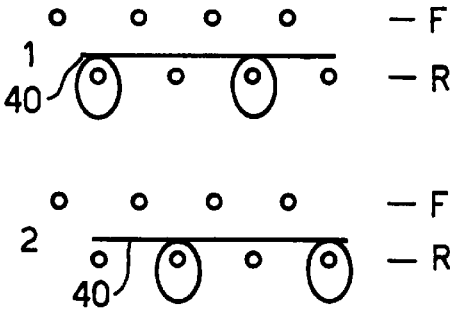
FIG. 5 is a knitting diagram showing a first stitch structure for knitting the less extensible courses.

Now with reference to FIG. 5, there are shown two rows 1 and 2 making a repeat unit. The front bed F is held up with all needles rendered inactive, and yarn 40 is knitted on every other needle on the rear bed R. The yarn 40 floats across inactive needles in the rear bed. This is called a 1×1 cross float single jersey.

Figure 6:
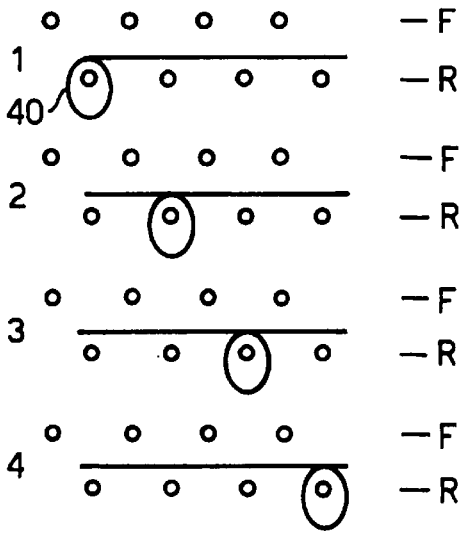
FIG. 6 is a second stitch structure for knitting the less extensible courses.

A second embodiment is shown on FIG. 6 which illustrates four rows 1–4 making a repeat unit. Again, the front needle bed F is rendered inactive, and the yarn 40 is knitted on every fourth needle with the yarn floating between the knitted needles. This is called a 3×1 cross float single jersey.

The second structure is less extensible than the 1×1 construction.

The yarn 40 is preferably one of the ground yarns of the double jersey fabric, but could be a high modulus yarn of the type discussed earlier.

In another embodiment of the invention, the tube 22 and tie-down 25 loops 23, 24 could be knitted on all needles on the rear bed R in single jersey construction from a high modulus yarn.

It is claimed:

1. A fabric cover knitted from yarn in a generally double jersey construction for covering a three-dimensional core, the fabric cover having an exposed front layer and a rear layer for lying adjacent the core, the rear layer of the cover having formed integrally therewith a coursewise extending single jersey tubular portion which is less extensible than surrounding fabric, with single jersey tie-down loops formed at each end of the tubular portion.

2. A cover as claimed in claim 1, wherein the tubular portion comprises six to 20 courses of single jersey knitting of a cross float construction.

3. A cover as claimed in claim 2, wherein the tie-down loops comprise 25 to 60 courses of single jersey knitting of a cross float construction.

4. A cover as claimed in claim 3, wherein the tie-down loops are formed contiguously with the tubular portion.

5. A cover as claimed in claim 4, wherein the tie down loops have a coursewise width of between six to 25 wales.

6. A cover as claimed in claim 1, wherein the single jersey tubular portion and the single jersey tie-down loops are knitted in a cross float construction in which in each row of knitting the yarn is knitted in a single loop at intervals which do not exceed four wales.

7. A cover as claimed in claim 6, wherein the yarn is knitted in loops formed in every other wale along a particular courseline.

8. A cover as claimed in claim 1, wherein the single jersey tubular portion and tie-down loops connect into the rear layer at two adjacent courses.

9. A cover as claimed in claim 1, wherein the tie-down loops and tubular portion are knitted at least in part from a high modulus yarn.

* * * * *